US011428103B2

(12) United States Patent
Angeloz et al.

(10) Patent No.: US 11,428,103 B2
(45) Date of Patent: Aug. 30, 2022

(54) AXIAL PISTON MACHINE

(71) Applicant: LIEBHERR MACHINES BULLE SA, Bulle (CH)

(72) Inventors: Didier Angeloz, Le Paquier (CH); Marko Del Aguila, Bern (CH)

(73) Assignee: LIEBHERR MACHINES BULLE SA, Bulle (CH)

( * ) Notice: Subject to any disclaimer, the term of this patent is extended or adjusted under 35 U.S.C. 154(b) by 0 days.

(21) Appl. No.: 16/841,477

(22) Filed: Apr. 6, 2020

(65) Prior Publication Data

US 2020/0318481 A1 Oct. 8, 2020

(30) Foreign Application Priority Data

Apr. 8, 2019 (DE) ..... 10 2019 109 180.2

(51) Int. Cl.
*F01B 3/02* (2006.01)
*F01B 3/00* (2006.01)

(52) U.S. Cl.
CPC ..... *F01B 3/007* (2013.01); *F01B 3/02* (2013.01)

(58) Field of Classification Search
CPC ..... F01B 3/106; F01B 3/007; F01B 3/02
See application file for complete search history.

(56) References Cited

U.S. PATENT DOCUMENTS

| | | | | |
|---|---|---|---|---|
| 3,256,830 | A | 6/1966 | Budzich | |
| 5,304,043 | A | 4/1994 | Shilling | |
| 7,730,826 | B2 * | 6/2010 | Becker | F04B 1/324 92/12.2 |

FOREIGN PATENT DOCUMENTS

| | | | |
|---|---|---|---|
| CH | 714321 | A1 | 5/2019 |
| CN | 105673375 | B | 12/2017 |
| JP | H0571528 | A | 3/1993 |

* cited by examiner

*Primary Examiner* — Michael Leslie
*Assistant Examiner* — Matthew Wiblin
(74) *Attorney, Agent, or Firm* — McCoy Russell LLP

(57) ABSTRACT

The invention relates to an axial piston machine comprising a drive shaft, a driving gear non-rotatably connected thereto with one or more driving gear pistons accommodated therein, whose piston stroke is adjustable by a swash plate, wherein at least one return spring acts on the swash plate and at least one adjusting piston is supported on the swash plate via an adjusting lever, a first and/or second stop is provided for the adjusting piston to limit the swivel angle of the swash plate, wherein a first stop is formed by the bottom of the blind hole within the connecting plate and/or a second stop is formed by a flat protrusion of the housing in the vicinity of the blind hole.

11 Claims, 5 Drawing Sheets

AXIAL PISTON MACHINE

CROSS-REFERENCE TO RELATED APPLICATION

The present application claims priority to German Patent Application No. 10 2019 109 180.2 filed on Apr. 8, 2019. The entire contents of the above-referenced application are hereby incorporated by reference for all purposes.

TECHNICAL FIELD

The invention relates to an axial piston machine comprising a drive shaft, a driving gear drum non-rotatably connected thereto with one or more driving gear pistons accommodated therein, whose piston stroke is adjustable by a swash plate.

BACKGROUND AND SUMMARY

The term axial piston machine includes both an axial piston pump and an axial piston motor. A special type of axial piston machine is the swash plate machine which comprises a driving gear in the form of a driving gear drum in which a plurality of driving gear pistons are axially shiftably mounted in corresponding cylinder bores of the driving gear. The driving gear is non-rotatably connected to the drive shaft of the axial piston machine, which for example in the operating mode of a pump is put into rotation by mechanical work. In pump operation, the pistons perform a stroke movement parallel to the axis of rotation from a particular starting position during half a revolution, so as to thereby draw in hydraulic fluid, hereinafter referred to as hydraulic oil for better readability, from the low-pressure side, whereas during the remaining half revolution they perform a full rotation about the axis of rotation to effect a lowering movement and thereby have brought the hydraulic oil previously drawn in to the high-pressure level and supply the same to the work output, i.e. to the high-pressure side. In the operating mode of a motor, the action principle is reversed by generating a rotary movement of the drive shaft by means of a controlled pressurization of the driving gear pistons.

The stroke of the driving gear pistons is determined by the swivel angle of the swash plate, also referred to as pivot cradle. The driving gear pistons performing the stroke movement always are aligned parallel to the drive shaft during rotation of the same, and by means of a sliding shoe, which is articulated to the pistons, each are pulled or urged into the movement specified by the swash plate and the retraction plate. The swash plate does not follow the rotary movement of the drive shaft so that the sliding shoes attached to the piston perform a sliding movement on the surface of the swash plate facing the sliding shoes. Thus, via the swivel angle of the swash plate, the stroke of the driving gear pistons used can be adjusted. The maximum stroke of the driving gear pistons results from the maximum possible swivel angle of the swash plate. The minimum stroke of the driving gear pistons results from the minimally possible swivel angle of the swash plate. Furthermore, there are axial piston machines in which the so-called swivelling-through of the swash plate across the neutral position, the so-called mooring operation, is provided, There are also axial piston machines in which two adjusting pistons act on the swash plate. At this point, it should be noted that the invention can also be applied to such axial piston machines.

The object of the present invention is to be seen in disclosing a suitable device for adjusting the swivel angle of the swash plate.

This object is achieved by an axial piston machine according to the features of claim 1. Advantageous embodiments of the axial piston machine are subject-matter of the dependent claims.

According to the invention, it now is proposed for an axial piston machine known per se to provide at least one adjusting lever for the adjustment of the swivel angle of the swash plate, which is aligned almost parallel and preferably parallel to the drive shaft and is axially shiftably mounted in the axial piston machine. The adjusting lever acts onto the swash plate at its end, whereby a change of the swivel angle of the swash plate can be effected by means of an axial movement of the adjusting lever.

In this way, a very simple and robust adjustment possibility is realized for the installed swash plate of the axial piston machine. The adjusting lever preferably extends from the swash plate approximately parallel to the drive shaft across the control plate into the rear housing region. This provides for mounting a possible actuation device for the adjusting lever at the rear end of the machine housing, which mostly is designed as a separate component, which greatly simplifies the installation and exchange of such an actuating device. Preferably, the adjusting lever engages the swash plate in the region of the outer circumference of the same, in particular in order to create enough space for the drum-like driving gear. As compared to a conventional axial piston machine, the diameter of the driving gear drum and/or of the control plate possibly must be dimensioned smaller and/or the diameter of the swash plate must be dimensioned greater. When the control plate comprises a reduced diameter, the control elements, in particular the control kidneys of the control plate, necessarily are placed closer to the drive shaft. The same applies for the piston bores within the driving gear drum.

According to an advantageous embodiment of the invention, the adjusting lever is designed mirror-symmetrical to a transverse axis of the adjusting lever. A mirror-symmetrical design simplifies the installation of the adjusting lever within the axial piston machine, as the risk of a wrong mounting position in general is eliminated. What can also be advantageous is a construction of the adjusting lever completely rotationally symmetrical to the longitudinal axis of the adjusting lever.

The attachment or connection of the adjusting lever to the swash plate preferably is achieved via a joint connection, in particular a ball joint connection. What is preferred is the formation of a ball head at the end of the adjusting lever on the side of the swash plate. The ball head formed there lies within a corresponding ball socket of the swash plate, in particular in the outer region of the swash plate.

According to a preferred embodiment, an adjusting piston is attached to the opposite end of the adjusting lever, which provides a hydraulically active surface for the hydraulically triggered actuation of the adjusting lever. Ideally, the adjusting piston is shiftably mounted within a bore of the machine housing adjusted to the adjusting piston in an axial direction of the adjusting lever. What is preferred particularly is a bearing of the adjusting piston within the connecting plate (see below) of the axial piston machine, in particular within a blind hole bore of the connecting plate. In such an arrangement, the actuating chamber then is disposed in the blind hole end and thus in a hollow volume of the connecting plate. Usually, the housing of an axial piston machine is of at least two-part design, wherein the main housing part accommodates the driving gear drum, the retraction plate, retraction sphere, control plate, swash plate, etc., and contains the largest length portion of the drive shaft and is open at its rear end, i.e. in the region behind the control plate, for assembly purposes. After the assembly of the components, this housing opening is closed by the connecting plate.

The connection between adjusting piston and adjusting lever likewise can be effected via a ball joint connection, wherein preferably the corresponding adjusting piston end is provided with a ball head.

At the contact surface between the adjusting lever and the swash plate on the one hand and on the other hand at the contact surface between the adjusting lever and the adjusting piston a surface treatment can be performed during the manufacture of these components. The surface treatment of these contact surfaces can effected for example by means of laser technology, which in particular relates to hardening, coating and structuring. For example, the contact surfaces of the spherical end regions of the adjusting lever can be laser-hardened and/or laser-structured, laser-coated and/or laser-structured, wherein structuring can promote the formation of oil pockets.

For limiting both the maximum and the minimum swivel angle of the swash plate at least one stop is provided for the adjusting piston. Preferably, the bottom of the blind hole within the connecting plate serves as a first stop. When the adjusting piston is disposed in this stop position, the maximum stroke of the driving gear pistons is obtained. Another stop is achieved by a flat protrusion of the main housing in the region of the blind hole. When the adjusting piston is disposed in this stop position, the minimum stroke of the driving gear pistons is obtained. The oil quantity delivered by the axial piston pump is required to maintain the self-lubrication and the hydrostatic relief.

What can also be used as a stop for the adjusting piston is a flat protrusion which is set back in the direction of the main housing from the stop surface between the main housing and the connecting plate. This abutment possibility can provide for an extended functional region, e.g. an increase of the swivel range in the same functional quadrant of the axial piston machine or the utilization of another function in another functional quadrant, e.g. the mooring function.

Furthermore, it is imaginable that the front side of the adjusting piston facing the bottom of the blind hole provides a certain cylindrical protrusion, in particular a central tab. Preferably, the bottom of the blind hole is not closed completely, but comprises a transition bore towards the geometrically downstream receptacle for a control or regulating valve.

Particularly preferably, the drilling axes of the blind hole and of the transition bore are disposed on a common straight line. The length of the tab is dimensioned such that the adjusting piston cannot be supported on the housing of the geometrically downstream control or regulating valve. A compression spring of the control or regulating valve can be supported on the central tab. In this embodiment, the adjusting pressure can be provided for the working surface of the adjusting piston via a control or regulating valve.

According to a preferred embodiment, the adjusting lever can be arrested at least at a long-side end region.

BRIEF DESCRIPTION OF THE FIGURES

Further advantages and properties of the invention will be explained in detail below with reference to an exemplary embodiment illustrated in the drawings, in which.

DETAILED DESCRIPTION

Figure 1:
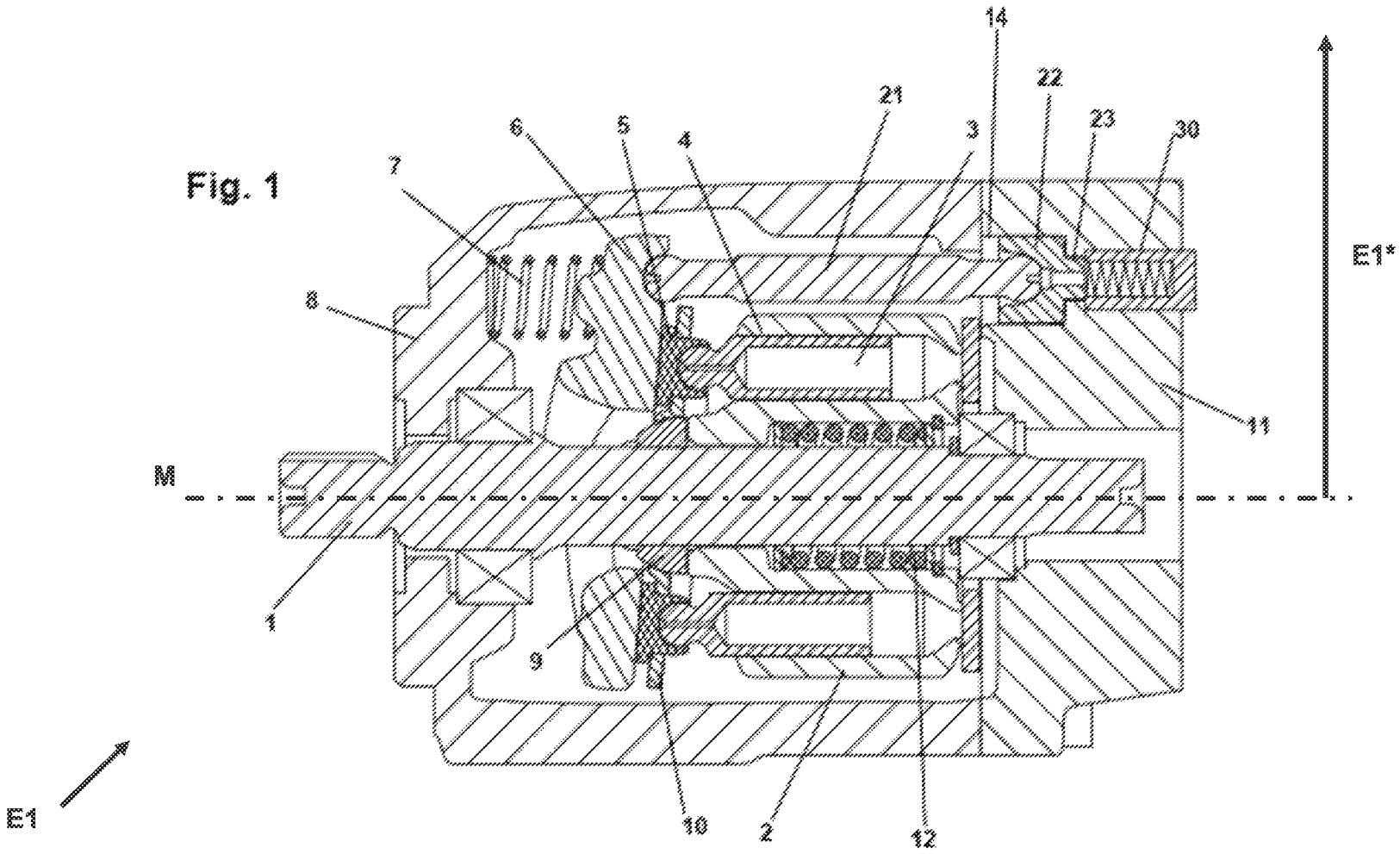
FIG. 1: shows a longitudinal section along the drive shaft through the axial piston machine according to the invention.
Figure 2:
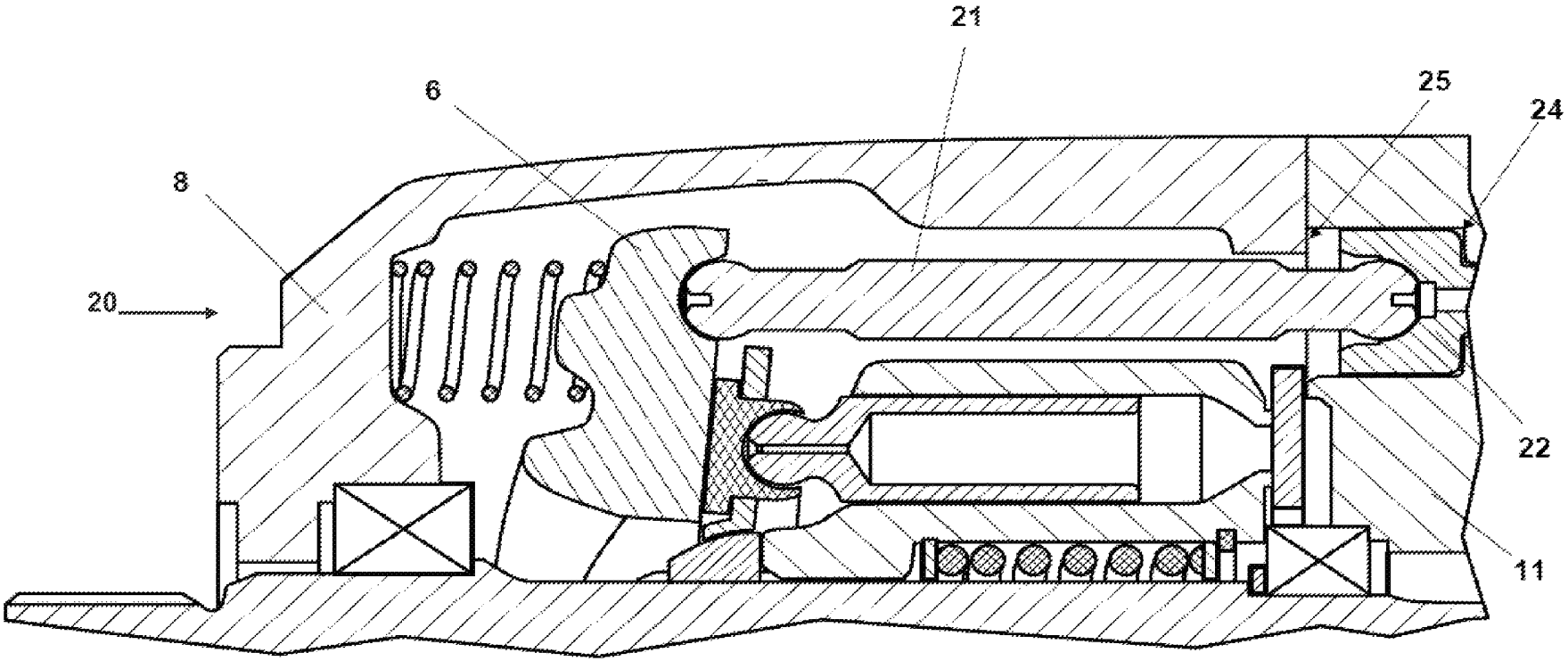
FIG. 2: shows a detail view of the upper half of the axial piston machine in the region of the adjusting lever.
Figure 3A:
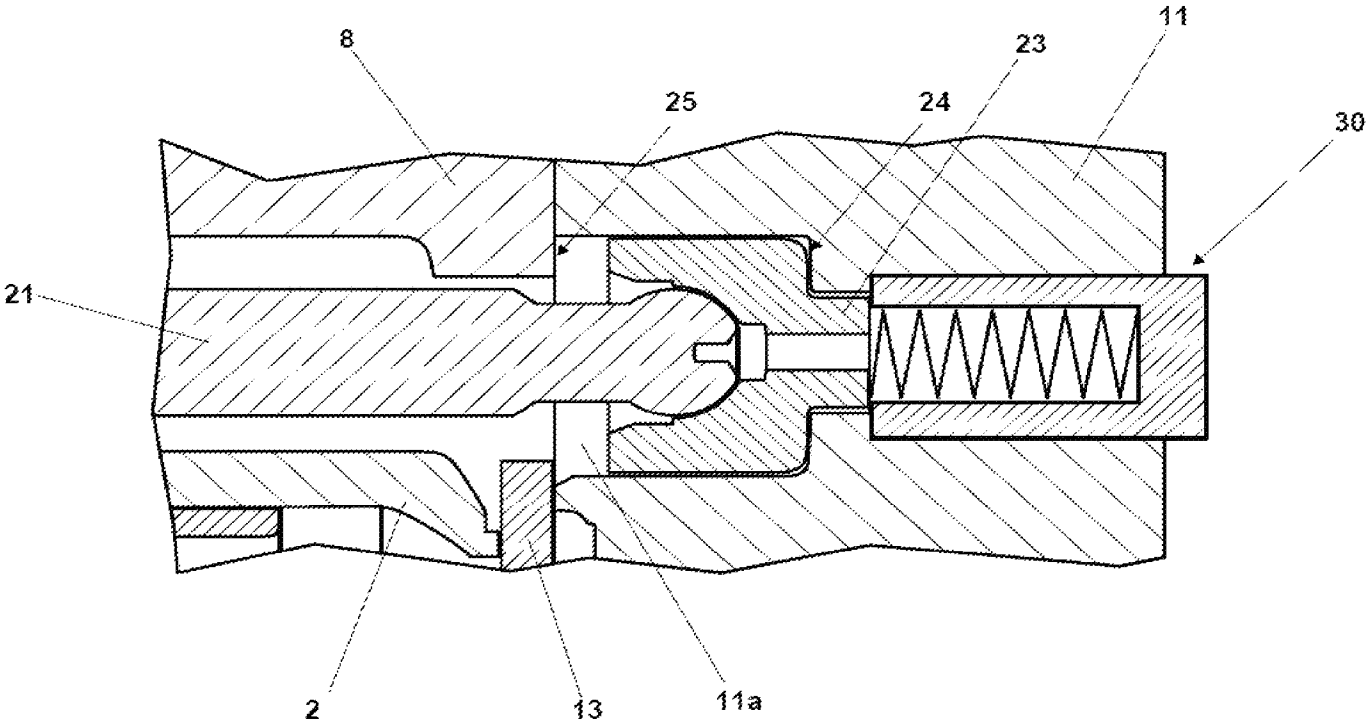
FIG. 3*a*: shows a detail view of the adjusting piston in a first limit stop position and in the illustrated second stop position.
Figure 3B:
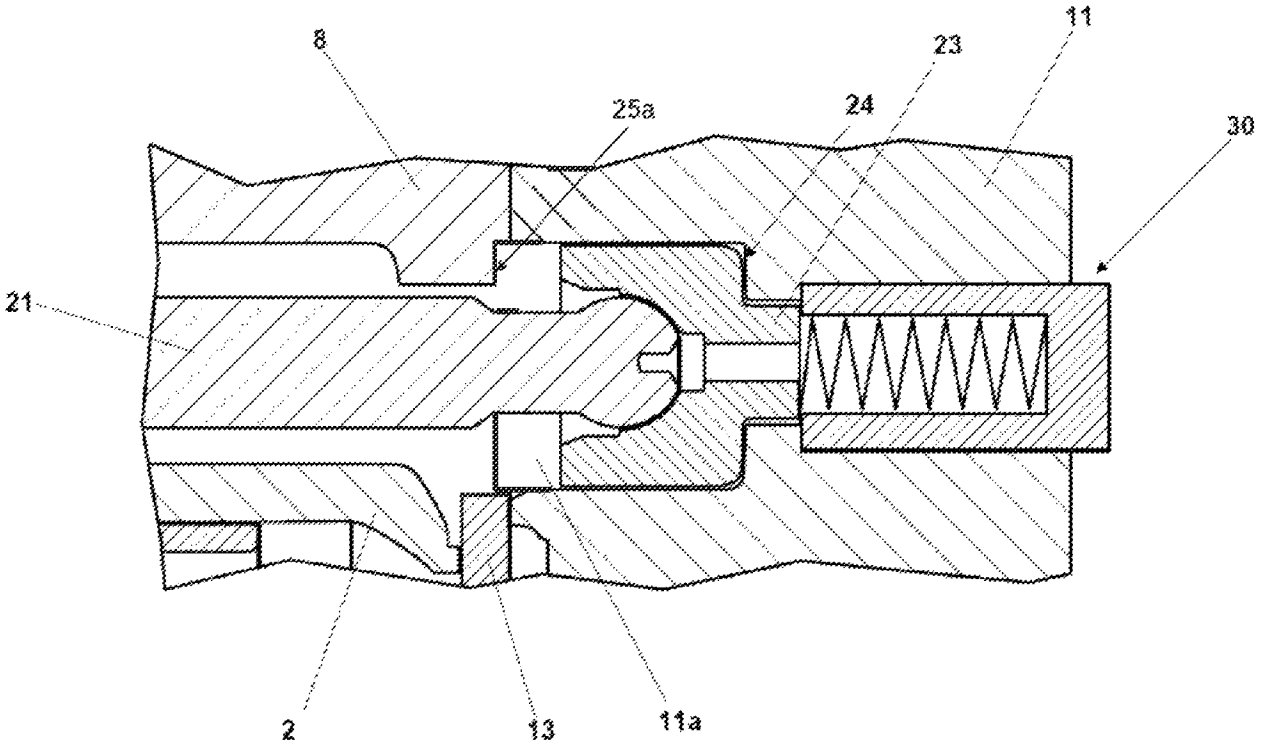
FIG. 3*b*: shows a detail view of the adjusting piston in a first limit stop position, and of an alternative for a second stop position.
Figure 4:
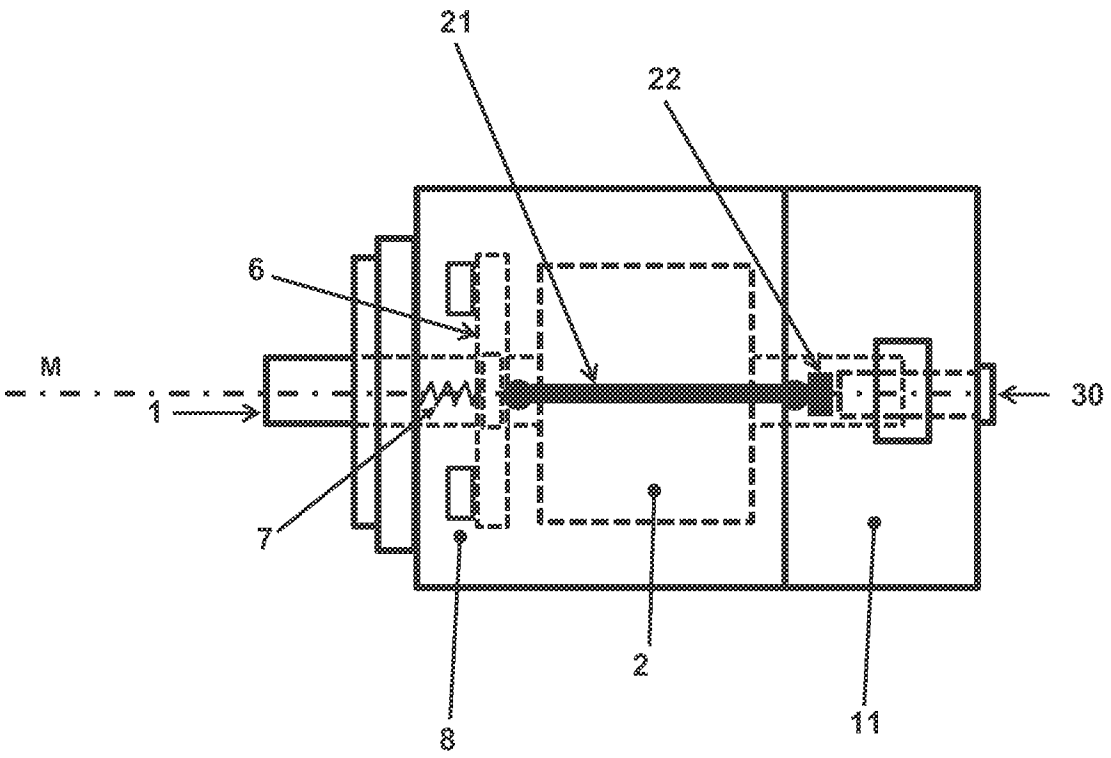
FIG. 4: shows a top view of a schematic representation of the axial piston machine according to the invention.

FIG. 1 shows an axial longitudinal section through the axial piston machine according to the invention. The invention will be described below with reference to an axial piston pump, but it is explicitly pointed out that the features of the invention can also be used without limitation in an axial piston motor. Furthermore, it is pointed out that the features of the invention can likewise be used for an axial piston machine which can operate in a multi-quadrant mode.

On the drive shaft 1 a driving gear drum 2 is non-rotatably arranged, in which a plurality of driving gear pistons 3 are inserted into cylinder bores 4 in the manner of a drum revolver. The driving gear pistons 3 each are supported on the swash plate 6 via a sliding shoe 5. The swash plate is supported on the main housing 8 via a compression spring 7. During a rotation of the drive shaft 1, the driving gear pistons 3 slide over the sliding surface of the swash plate 6 by means of their sliding shoes 5, and in dependence on the swivel angle of the swash plate 6 a stroke movement of the driving gear pistons 3 occurs. Depending on the operating mode of the axial piston machine, i.e. pump or motor mode, hydraulic energy or mechanical power is produced thereby.

A retaining device ensures that the treads of the sliding shoes 5 of the driving gear pistons 3 do not lose contact with the sliding surface of the swash plate 6 also during their suction phase. Among other things, the retaining device consists of a retraction plate 10 and of the retraction ball 9 coaxially sitting on the drive shaft 1. By means of the spring 12, said retraction ball is urged to the left in the direction of the swash plate 6 in the drawing plane (plane E1) and in the illustrated embodiment in a half-plane E1* proceeding from the drive shaft axis, and thereby is supported on the retraction plate 10. The retraction plate 10 thereby is in permanent contact with the sliding shoes 5 and presses their treads onto the swash plate 6. The driving gear drum 4 is urged in the direction of the control plate 13 by the central spring 12.

The stroke of the driving gear pistons 3 is specified by the swivel angle of the swash plate 6, which in operation can be changed via an adjusting device 20. The adjusting lever 21 preferably has a spherical end region on both sides, wherein the one side of the adjusting lever 21 each forms a joint connection, in particular a ball joint connection, with the swash plate 6, and the other side with the adjusting piston 22. The adjusting lever 21 can be rotationally symmetrical with respect to its longitudinal axis and/or be configured mirror-symmetrical to a vertical axis. The adjusting lever 21 extends in an axial direction from the swash plate 6 beyond the control plate 13 into a blind hole 14 which is disposed within the connecting plate 11 and in which the adjusting piston 22 is guided. The adjusting lever can be arrested in its joint connection at at least one of the two longitudinal ends. Within the connecting plate 11 a control or regulating valve 30 can be accommodated.

The spherical adjusting lever end opposite the swash plate 6 forms a ball joint connection with the spherical recess in the adjusting piston 22. The adjusting piston 22 is axially shiftably mounted within the blind hole 14 of the connecting plate 11. On its end face opposite the spherical recess, the piston 22 has a small cylindrical tab 23 on which a compression spring of the control or regulating valve 30 can be supported.

The limitation of the adjusting movement for the swash plate 6 is effected by two stops for the adjusting piston 22 in the vicinity of the blind hole 14. A first stop 24 for limiting the maximum swivel angle is formed by the bottom of the blind hole 14 so that here the maximum slide-in path of the adjusting lever 21 into the blind hole 14 is delimited. A second stop for the adjusting piston 22 to limit the minimum swivel angle is formed by a flat protrusion 25 or 25*a* of the machine housing 8 in the vicinity of the blind hole 14.

The described arrangement allows to utilize the overall length of the connecting plate 11 for accommodating the control or regulating valve 30. The same can be inserted or screwed into the connecting plate 11 from outside so that a simple exchange of the valve 30 is possible.

Further advantages of the constructional arrangement:

By slightly changing the angle of the adjusting lever 21 to the middle axis of the adjusting piston 22 a power transmission almost free from transverse forces is achieved in the vicinity of the adjusting piston 22. This is also promoted by the spherical region of the adjusting lever 21 dipping into the inner region of the adjusting piston 22.

An adjusting lever 21 with two identical spherical end regions facilitates the assembly. The tribology in the functional region of the ball joint connections between the adjusting lever 21 and the adjusting piston 22 as well as the swash plate 6 can be further improved by supplying hydraulic oil. When a tubular material is used for the adjusting lever 21, the supply of the ball joint connection in the vicinity of the swash plate 6 with hydraulic oil is possible in a simple way.

Also taking account of the friction behavior, the weight and the cost, materials such as plastics, brass, aluminum or aluminum alloys can be used for the adjusting lever 21.

What furthermore is advantageous is the uniform loading of the swash plate bearing 40 by the forces centrally introduced to the bearing points from the adjusting device 20.

LIST OF REFERENCE NUMERALS

1 drive shaft
2 driving gear drum
3 driving gear piston
4 cylinder bores
5 sliding shoe
6 swash plate
7 compression spring
8 main housing
9 retraction ball
10 retraction plate
11 connecting plate
14 blind hole
12 spring
13 control plate
20 adjusting device
21 adjusting lever
22 adjusting piston
23 cylindrical tab
24 blind hole bottom
25 flat protrusion
25*a* flat protrusion
30 control or regulating valve
E1 plane
E1* half-plane

The invention claimed is:

1. An axial piston machine comprising a drive shaft, a cylinder drum non-rotatably connected thereto and comprising one or more driving gear pistons accommodated therein, whose piston stroke is adjustable by a swash plate, wherein at least one return spring acts on the swash plate and at least one adjusting piston is supported on the swash plate via an adjusting lever, wherein a first stop formed by a bottom of a blind hole within a connecting plate and/or a second stop formed by a flat protrusion of a housing in the vicinity of the blind hole are provided for the at least one adjusting piston to limit a swivel angle of the swash plate, wherein a drive shaft axis M, a longitudinal axis of the at least one adjusting piston, a longitudinal axis of the adjusting lever, a central axis of the at least one return spring and a central axis of a control valve almost are located on a half-plane E1* proceeding from the drive shaft axis.

2. The axial piston machine according to claim 1, wherein the at least one adjusting piston is guided in the blind hole within the connecting plate.

3. The axial piston machine according to claim 2, wherein the control valve is arranged coaxially to the at least one adjusting piston and/or wherein the at least one adjusting piston is further located in the connecting plate and the control valve are located in the connecting plate.

4. The axial piston machine according to claim 3, wherein the adjusting lever provides for approximately coaxial functional positions relative to the longitudinal axis of the at least one adjusting piston.

5. The axial piston machine according to claim 2, wherein the adjusting lever has a spherical end region on each of two opposite sides of the adjusting lever, wherein the spherical end region on one of the two opposite sides of the adjusting lever forms a ball joint connection with a spherical recess in the at least one adjusting piston, and wherein the spherical end region on the one of the two opposite sides of the adjusting lever protrudes into an interior of the at least one adjusting piston at least up to an equator of the spherical end region.

6. The axial piston machine according to claim 5, wherein at least in a contact region of the ball joint connection with the at least one adjusting piston and a pivot cradle the adjusting lever undergoes a surface treatment which relates to hardening, coating and structuring, wherein here one or more methods of laser technology are applied.

7. The axial piston machine according to claim 5, wherein the spherical end region on the one of the two opposite sides of the adjusting lever protrudes into the interior of the at least one adjusting piston beyond the equator of the spherical end region.

8. The axial piston machine according to claim 1, wherein the adjusting lever is configured rotationally symmetrical to the longitudinal axis of the adjusting lever and/or mirror-symmetrical to a transverse axis of the adjusting lever.

9. The axial piston machine according to claim 1, wherein the adjusting lever is arrestable at least at a long-side end region.

10. The axial piston machine according to claim 1, wherein the adjusting lever comprises plastics, brass, aluminum or an aluminum alloy.

11. The axial piston machine according to claim 1, wherein the at least one return spring is positioned between the swash plate and the housing.

* * * * *